United States Patent [19]

Davis

[11] Patent Number: 4,725,170

[45] Date of Patent: Feb. 16, 1988

[54] RETAINED EARTH STRUCTURE AND METHOD OF MAKING SAME

[75] Inventor: Edgar Davis, San Jose, Calif.

[73] Assignee: VSL Corporation, Los Gatos, Calif.

[21] Appl. No.: 916,379

[22] Filed: Oct. 7, 1986

[51] Int. Cl.[4] ..... E02D 29/02

[52] U.S. Cl. ..... 405/286; 405/284

[58] Field of Search ..... 405/258, 262, 272, 284–287; 403/79, 209; 256/24, 26

[56] References Cited

U.S. PATENT DOCUMENTS

| | | | |
|---|---|---|---|
| 2,152,816 | 4/1939 | Olson | 256/24 |
| 3,686,873 | 8/1972 | Vidal | 405/262 |
| 4,116,010 | 9/1978 | Vidal | 405/286 X |
| 4,324,508 | 4/1982 | Hilfiker et al. | 405/258 X |
| 4,449,857 | 5/1984 | Davis | 405/286 |
| 4,470,728 | 9/1984 | Broadbent | 405/286 X |

FOREIGN PATENT DOCUMENTS

| | | | |
|---|---|---|---|
| 2014222 | 8/1979 | United Kingdom | 405/286 |

*Primary Examiner*—Nancy J. Stodola

*Attorney, Agent, or Firm*—Fliesler, Dubb, Meyer & Lovejoy

[57] ABSTRACT

A soil retaining system, including an upright soil retaining wall of modular facing panels and a number of horizontal wire mesh reinforcement units, including spaced parallel wires ending in hole forming loop and interconnected by perpendicular crossbars. The mesh units are connected in tiers to the retaining wall and rest in the soil behind the wall. The connection of each wire in a mesh unit is made by a clevis member embedded into the back side of the panel and a bolt and nut assembly or an elongated pin member for attaching the wires and the clevis.

11 Claims, 16 Drawing Figures

RETAINED EARTH STRUCTURE AND METHOD OF MAKING SAME

BACKGROUND OF THE INVENTION

1. Field of the Invention

The present invention relates to retained earth structure in general and in particular to a retained earth structure comprising a plurality of interlocked facing wall modules connected to elongated wire mesh reinforcing panels by means of a novel clevis and bolt assembly.

2. Description of the Prior Art

A retained earth structure comprises a wall for retaining earth and/or other backfill material placed behind the wall. Elongated members extend from various locations on the back surface of the wall into the backfill material. The elongated members are captured by the backfill material and prevent the wall from buckling outwardly.

The wall may comprise a uniform, unbroken expanse of concrete or the like which is poured on site. Alternatively, the wall may comprise a plurality of interlocking precast modules or wall members which are assembled on site.

The use of precast modules tends to be less expensive than on-site poured concrete because the installation and removal of the forms required when concrete is poured on site and the transportation to and pouring of large amounts of concrete on site are generally not required. Moreover, the amount of labor required for assembling the modules is generally less than that required for poured concrete walls.

Initially, the elongated members used for preventing the outward buckling of the wall in retained earth structures comprised elongated straps of material having a generally rectangular cross-section. Outward movement of the wall and the straps from the backfill material was prevented by means of friction between the backfill material and the straps.

Several methods and apparatus have been provided in the past for attachaing the strap members to individual wall modules. For example, in U.S. Pat. No. 3,686,873, there is disclosed a number of structures comprising a plurality of individual strap members which are attached to a plurality of wall modules. In one such structure one or more U-shaped members having widely spaced legs are anchored in each one of the wall modules. The ends of each leg of each U-shaped member extends beyond the back surface of the module. A bolt and nut assembly is used to attach one end of each strap member to the end of each of the legs of each of the U-shaped members.

In another one of the structures disclosed in the patent, one or more ring-shaped members are anchored in each of the modules and one end of each strap member is passed through the ring-shaped member, folded back on itself and bolted or riveted to an underlying section thereof.

In still another one of the structures disclosed in the patent, the end of each strap member is attached to the modules by passing a rod or pin used for interlockng the modules together through a hole provided therefor in the end of the strap member.

In U.S. Pat. No. 4,449,857, there is disclosed a structure comprising a plurality of wire mesh panels which are attached to a plurality of wall modules by means of threaded female fittings anchored in the wall modules and threaded male fittings movably mounted to the end of each elongated wire in the wire mesh panel.

In each panel there is provided a plurality of four to six elongated parallel ½" to ⅜" wires which are spaced six inches apart and interconnected by crossbars which are welded perpendicularly to the wires on 24-inch centers.

The advantage that the wire mesh panels have over the previously described straps is that, in addition to friction forces, outward movement of the panels and the wall modules attached thereto is further restrained by the crossbars which engage the backfill material bearing downwardly thereon.

Disadvantages of the prior known wire mesh panel structures are that the threaded female and male fittings used for attaching the wire mesh panels to the wall modules are relatively expensive to make; the threading of each male fitting into each female fitting during installation is relatively time consuming; and the strength of each attachment corresponds to the relatively limited strength of an enlarged protuberance located at the end of each wire in the panel for retaining the male part of the fitting.

SUMMARY OF THE INVENTION

In view of the foregoing, principal objects of the present invention are a method and apparatus for building a retained earth structure comprising a plurality of interlocking facing wall modules connected to elongated wire mesh reinforcing panels by means of a novel clevis and bolt assembly.

In accordance with the above objects, there is provided a clevis formed from a section of reinforcing bar. The section of reinforcing bar is bent to form a U-shaped member. The ends of the legs of the U-shaped member are folded back on themselves to form a loop or hole. Another straight section of reinforcing bar is then welded to the interior of the U-shaped portion of the member and extends above and below the plane of the legs of the member in a direction generally perpendicular thereto.

Each of the wall modules is precast. In the course of precasting each of the wall modules, a plurality of 4 to 6 clevises are anchored in a line in the module. Depending on the size of the module, a plurality of parallel rows of clevises may be anchored in a module.

In addition to the clevises, there is provided a plurality of elongated generally rectangular wire mesh panels. Each of the panels comprises a plurality of elongated parallel spaced wires. Spaced crossbars are welded to the wires in a direction generally perpendicular thereto. One end of each of the wires is folded back on itself for forming a loop or hole.

In one embodiment of the present invention, to connect each of the wires in a panel to a clevis, there is provided a bolt and nut assembly. The bolt has a threaded shaft of sufficient length to pass through both legs of the clevis and the wire loop located therebetween and to have the nut threaded thereon. Extending from the head of the bolt there is provided a tear-shaped shoulder. The tear-shaped shoulder is provided to be inserted in the hole formed in one of the legs of the clevis so as to prevent rotation of the bolt when the nut is threaded thereon.

In another embodiment of the present invention, an elongated pin is provided for attaching the ends of the wires in each wire mesh panel to a corresponding number of clevises. The ends of the pin are bent to prevent the wires from becoming detached from the clevises.

In use, a course of wall modules, with the ends of the legs of each of the clevises projecting from the rear surface thereof, are assembled on a level foundation. Soil or backfill material is then placed behind the wall up to the level of the first row of clevises. A reinforcing panel is then spread across the backfill rearwardly of the wall. Each of the wires in each panel is then attached to a corresponding clevis by means of the bolt and nut assembly or the elongated pin. After the attachment of the panels of the first course is completed, additional backfill material is placed over the panels in the first course up to a level just below the next highest row of clevises. The above-described attachment of panels to the next highest row of clevises is repeated, followed by the placing of additional backfill material on the next highest row of panels. This procedure is repeated until the wall achieves its desired height.

The advantage of the apparatus and method of the present invention is that conventional materials are used for forming the clevis and panel members and the means for attaching the panels to the clevises is relatively inexpensive, quick and easy.

BRIEF DESCRIPTION OF THE DRAWING

Other objects, features and advantages of the present invention will become apparent upon a consideration of the following detailed description and the accompany drawings, in which.

DETAILED DESCRIPTION OF THE INVENTION

Figure 1:
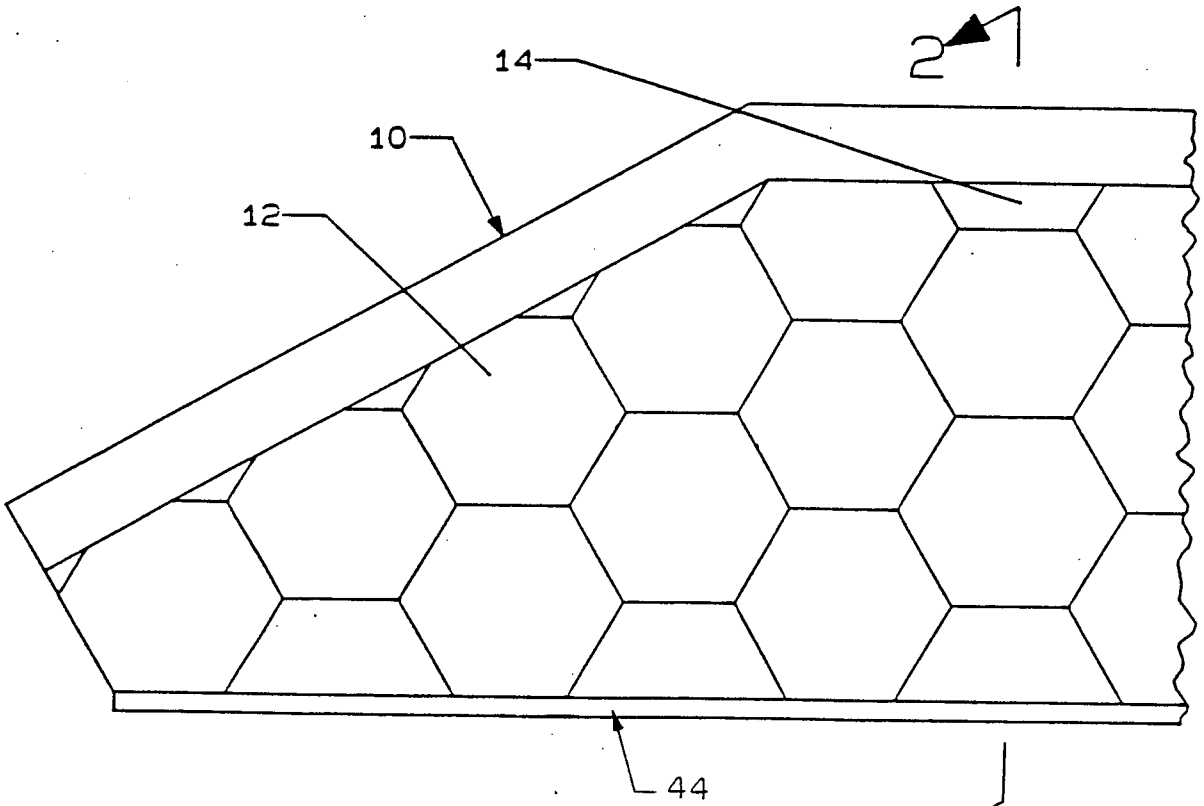
FIG. 1 is an elevation view of a number of modular facing panels arranged in a retaining wall according to the present invention.
Figure 2:
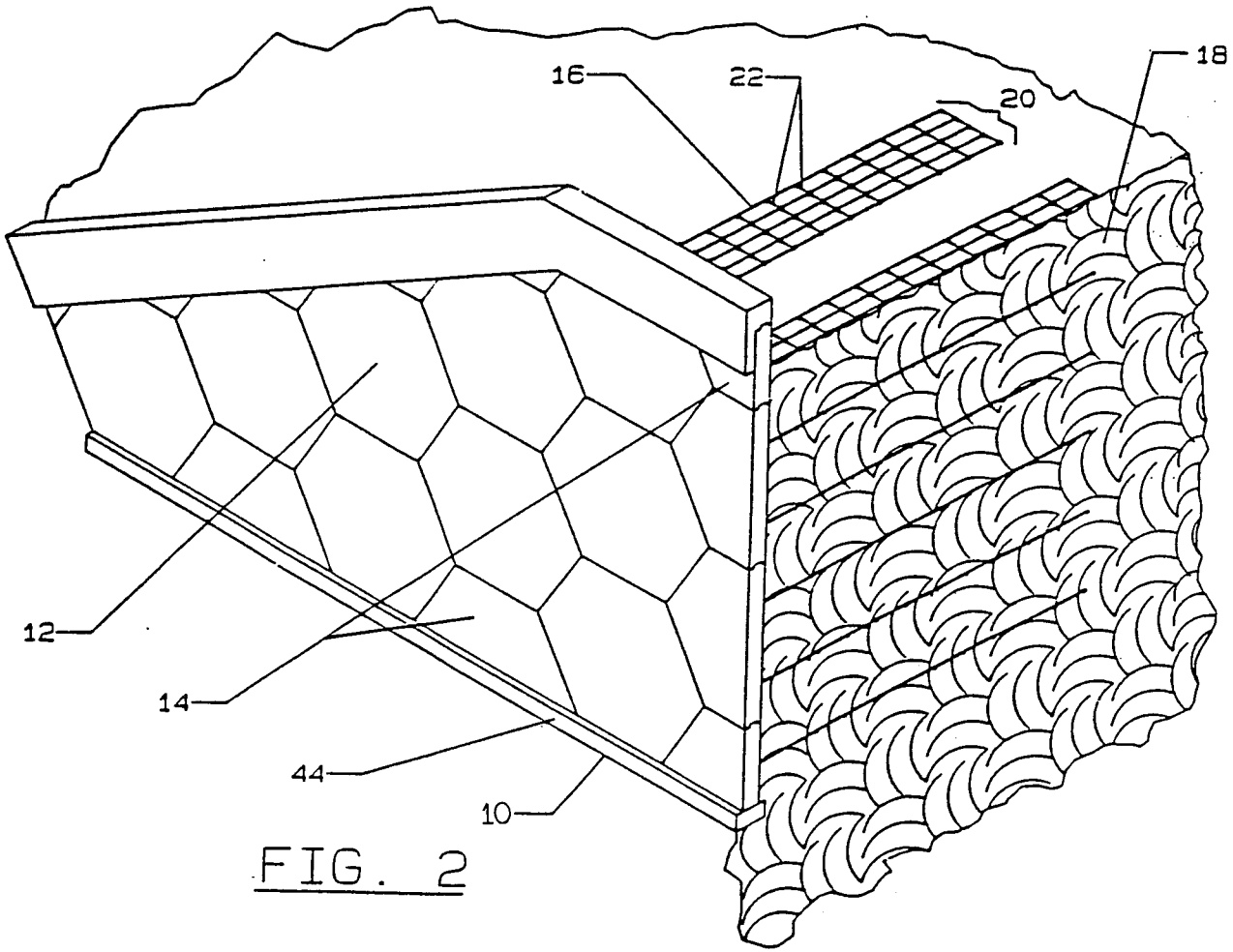
FIG. 2 is a schematic cross-sectional view of the retaining wall of FIG. 1, illustrating connected mesh reinforcement panels embedded in soil.

Referring to FIGS. 1 and 2, a retained earth retaining wall system is illustrated in accordance with the present invention. It includes an upright, typically vertical, retaining wall, generally designated by the number 10, formed of interlinked modular facing full panels 12 and half facing panels 14 to be described more fully below. Extending from the backside of panels 12 and 14 in a generally horizontal direction are wire mesh soil reinforcement panels 16, embedded into the soil, generally designated by the number 18. A mesh reinforcement panel includes a plurality, generally four to six, of generally parallel spaced metal wires 20 interconnected by parallel spaced crossbars 22, preferably by welding at crossover points. Crossbars 22 are generally perpendicular to wires 20.

Figure 2A:
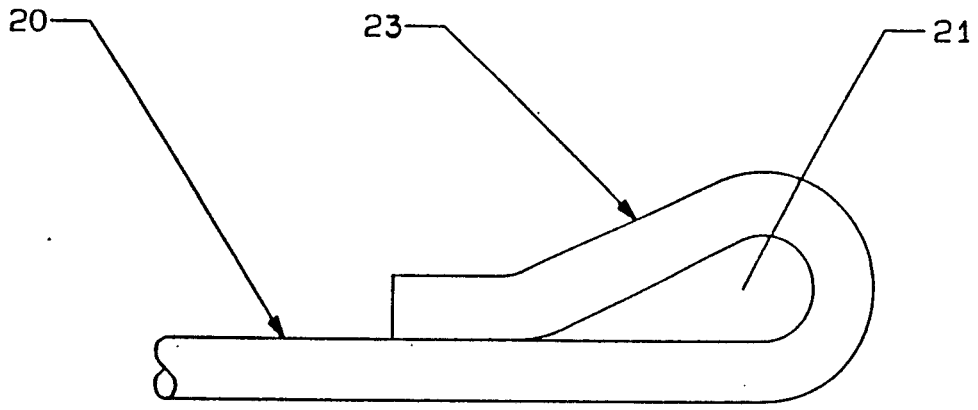
FIG. 2A is a side elevation view of the end of one of the wires in the mesh of FIG. 2.

Referring to FIG. 2A, one end of each of the wires 20 is terminated with a tear-shaped hole 21. The hole 21 is formed by bending a section 23 of the end of each of the wires 20 back on itself. Typically, a machine is provided for bending the ends of all of the wires in a panel simultaneously to form the whole 21.

As set out below, the soil reinforcement panels are attached to the soil retaining wall facing panels in spaced horizontal layers from the bottom to the top, with soil being layered above the lowermost one up to a level at which the next unit in order is attached to the retaining wall. In this manner, the mesh reinforcement panels are embedded into the soil.

The nature of this system is such that soil reinforcement panels 16 accept soil pressure against crossbars 22 in bearing (i.e., soil against bar). This bearing pressure is transferred to the lateral parallel wires 20. This system is an improvement over the use of strips in that strips require the development of tensile strength through frictional contact with the soil which, in turn, requires that strict limits be maintained on the embankment soil and its placement in the soil mass.

Any number of different spacing of wires 20 and crossbars 22 may be employed in accordance with known practice. One suitable type of unit includes $\frac{3}{8}$ in. diameter wires 20 and crossbars 22 forming a grid typically with 6 inches between wires and 24 inches between crossbars. The welds between the wires and crossbars should be sufficient to develop the full yield strength of the longitudinal wires and to develop a shear strength equal to or greater than 50% of the longitudinal wire yield strength.

Figure 3:
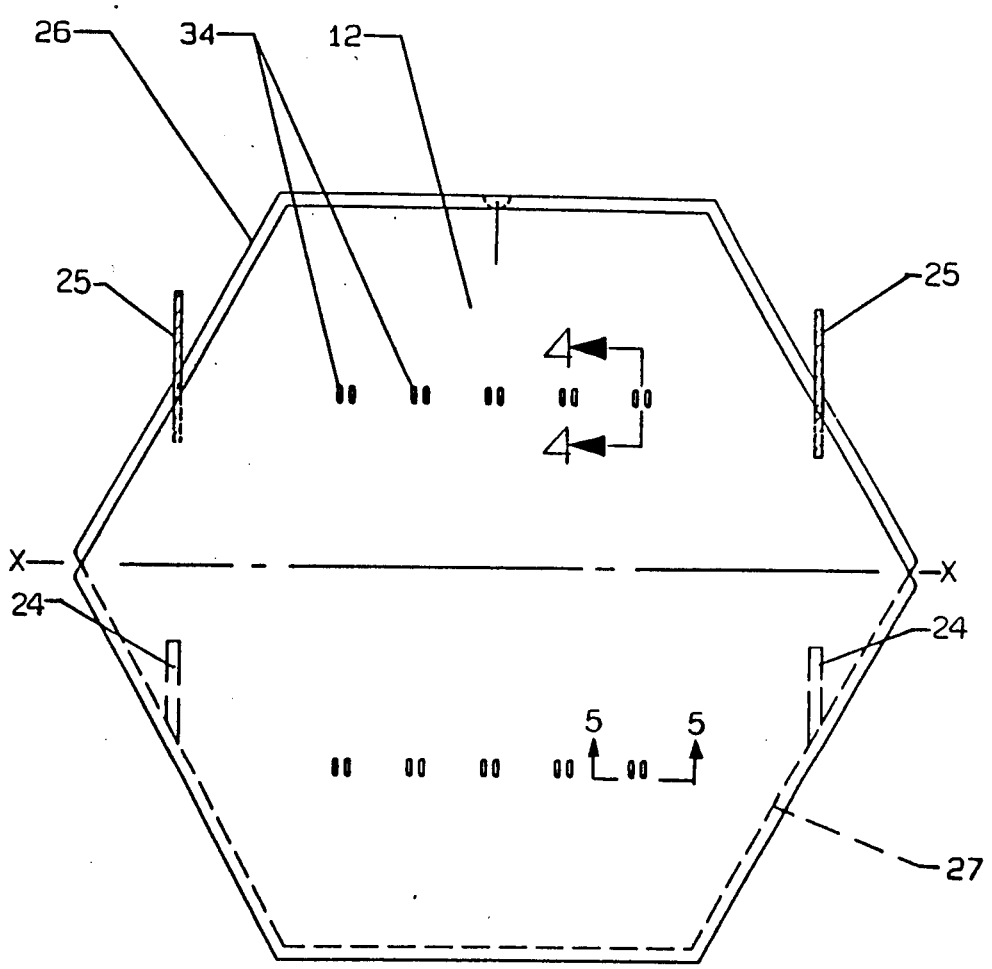
FIG. 3 is a rear elevation view of a modular facing panel illustrating embedded clevis members in accordance with the present invention.

Referring to FIGS. 2 and 3, a suitable modular facing panel 12 is illustrated. It is hexagonal in shape and is suitably formed by casting concrete into the desired shape. Each unit includes holes 24 for receiving vertical linking pins 25 which project through adjacent panels to interlock the facing panels together into retaining wall 10. In addition, tongues 26 are provided at the edges of the panels for mating with corresponding grooves 27 in adjacent panels for alignment and stability.

A suitable panel measures 5 feet between facing end walls. However, larger panels may prove more suitable for larger wall projects. To provide a level wall, half-panels 14 are interlinked alternately at the top and bottom of the wall as illustrated in FIG. 1.

Referring to FIG. 3, such a half-panel is suitably formed from a full panel cut in half along the line X—X. Other panel configurations will be necessary to interlock with full and half panels when the upper edge of the wall is required to be sloped instead of flat relative to a horizontal line. Alternately, panel segments may be cast individually.

A main feature of the present invention is the provision of a convenient mode of connecting retaining wall facing panels 12, half-panels 14 and other applicable panel configurations to soil reinforcement panels 16.

Referring to FIGS. 4–13, an assembly generally designated by the number 30 is utilized to provide such a connection. In assembly 30 there is provided a clevis 31, a bolt 40 and a nut 41. Clevis 31 comprises a pair of leg members 32 and 33 which extend from a U-shaped section 34. In the interior of the U-shaped section 34, there is provided a straight rod-shaped member 35. The member 35 is rigidly attached to the section 34, as by welding, and extends in opposite directions and perpendicular to the plane of the legs 32 and 33. On their free ends, each of the legs 32 and 33 is provided with a tear-shaped hole 36. The hole 36 is formed by bending a section 37 of each of the legs 32 and 33 back on itself and rigidly attaching the end thereof 38 to the underlying leg, as by welding. Typically, each of the clevises 31 is formed from sections of reinforcing bar material having the same structural and physical characteristics of the material used for making the reinforcing panels 16.

Referring to FIGS. 9–12, in the bolt 40 there is provided an elongated shaft portion 42. At one end of the shaft portion 42 there is provided a head member 43. At the opposite end of the shaft portion 42 there is provided a plurality of external threads 44. Etending from the head 43 there is provided a tear-shaped shoulder 45. The shape of the shoulder 45 corresponds to the tear-shaped hole 36 in each of the legs 32 and 33 of the clevis 31.

In the nut 41 there is provided a flange 47. Extending from the flange 47 there is provided an hexagonal member 48 which is adapted to be engaged by a wrench for threading the nut 41 onto the bolt member 40, as will be further described below.

Figure 5:
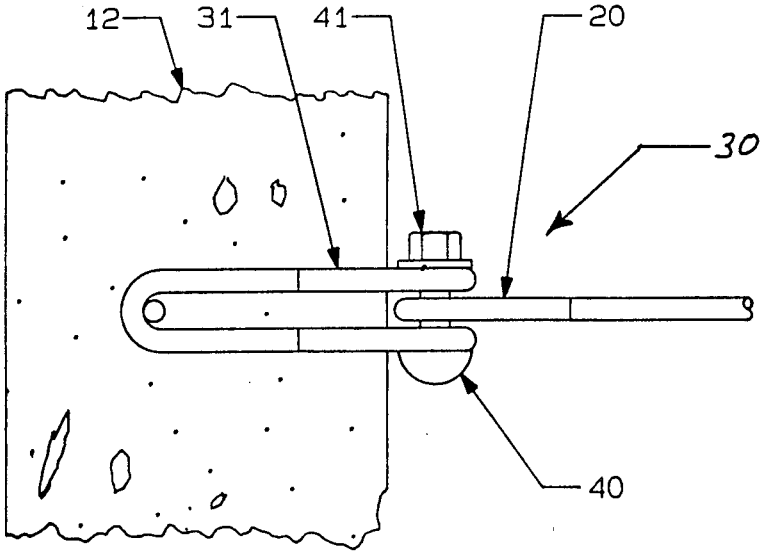
FIG. 5 is a cross-sectional view of a portion of the modular facing panel and a clevis taken in the direction of lines 5—5 of FIG. 3.
Figure 4:
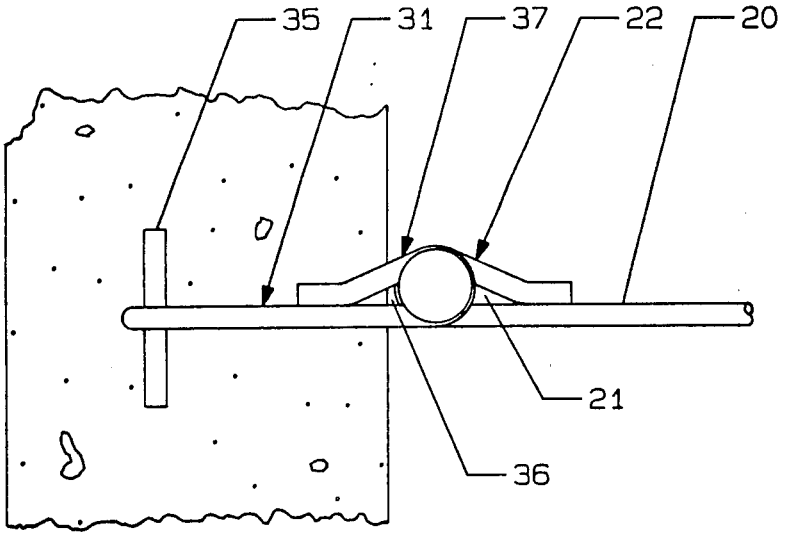
FIG. 4 is an enlarged side cross-sectional view taken in the direction of lines 4—4 of FIG. 3 of a portion of the modular facing panel, clevis and a portion of a reinforcement panel according to the present invention.
Figure 7:
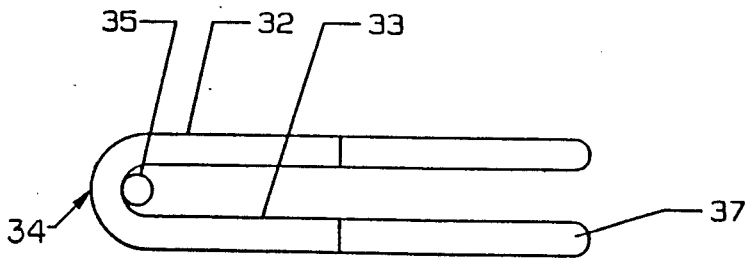
FIG. 7 is a top plan view of FIG. 6.
Figure 6:
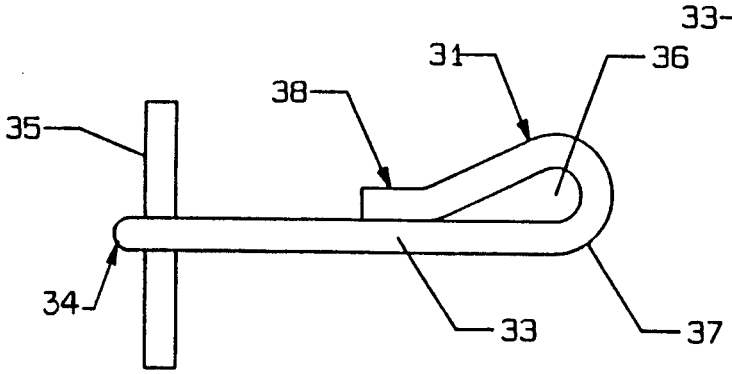
FIG. 6 is a side elevation view of a clevis according to the present invention.
Figure 8:
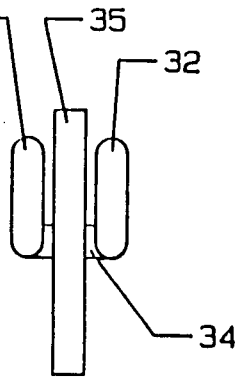
FIG. 8 is an end elevation view of FIG. 6.
Figure 12:
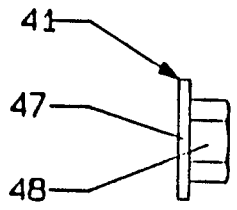
FIG. 12 is a side elevation view of FIG. 11.
Figure 11:
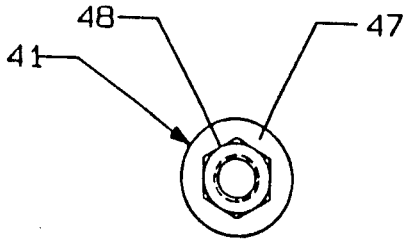
FIG. 11 is an end elevation view of a nut according to the present invention.
Figure 9:
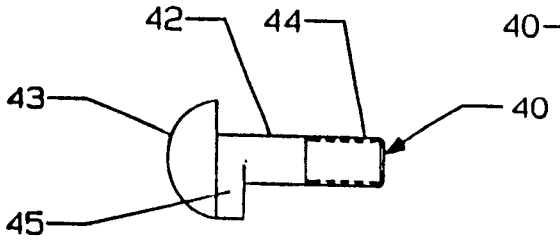
FIG. 9 is a side elevation view of a bolt according to the present invention.
Figure 10:
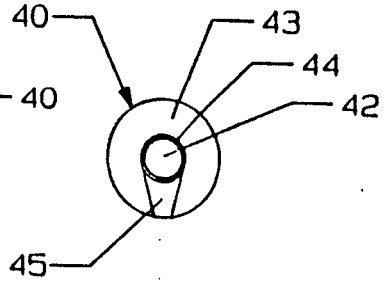
FIG. 10 is an end elevation view of FIG. 9.
Figure 13:
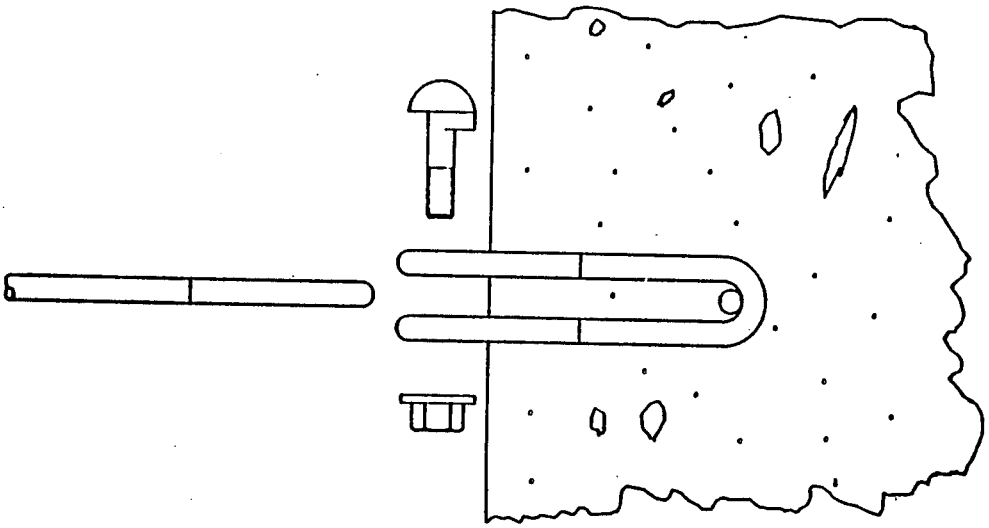
FIG. 13 is a top plan exploded view of the apparatus of FIGS. 4 and 5.

In a preferred embodiment, the clevises 31 are cast in place within the concrete facing panels 12 and 14, as illustrated in FIGS. 3–5. Specifically, the clevises 31 are mounted such that a predetermined length of each of the legs 32 and 33, including the tear-shaped hole 36, extend beyond the back surface of the modules 12 and 14 so that one of the nut and bolt assemblies 40, 41 can be used to couple the ends of each of the wires 20 to the corresponding clevis. In practice, a plurality of clevises 31 are mounted in a row side by side with a spacing corresponding to the spacing between the wires 20 and each of the panels 16. For full-sized modules such as the module 12, there are generally two rows of clevises provided in each module, such as shown in FIG. 3. For half-size modules such as module 14, generally one row of clevises 31 is sufficient. Also, it may be noted that in some applications, especially in the upper portions of a wall, it may be sufficient for alternate modules to be anchored to panels 16 if the interlocking features of each of the module are sufficiently strong enough to withstand the forces tending to buckle the module outwardly.

One suitable procedure for forming the overall soil retaining system of the present invention is as follows. The soil is first leveled at the desired depth. Then a leveling pad 44 (typically formed of concrete 1 ft. wide×0.5 ft. deep) is placed on the soil. A bottom layer of upright, alternating full and half-facing panels, illustrated in FIG. 1, is then placed on the leveling pad. These panels are supported and held vertically by temporary braces on the front or finished side of the wall. Pins 25 are placed in holes 24 interlocking adjacent panels to provide additional support. The panels are disposed in the manner illustrated in FIGS. 3 and 4, so that the clevis 31 extends toward the soil in spaced horizontal relationship. The soil is then backfilled up to the lowermost row of clevises 31 of the panels 12, 14. The holes 21 in the ends of the wires of a first panel 16 are slid between the holes 36 in the ends of the legs 32 and 33 of each clevis 31 in a row. The wires of panels 16 are then attached to the clevises 31 by means of a corresponding number of bolts 40 and nuts 41.

Figure 14:
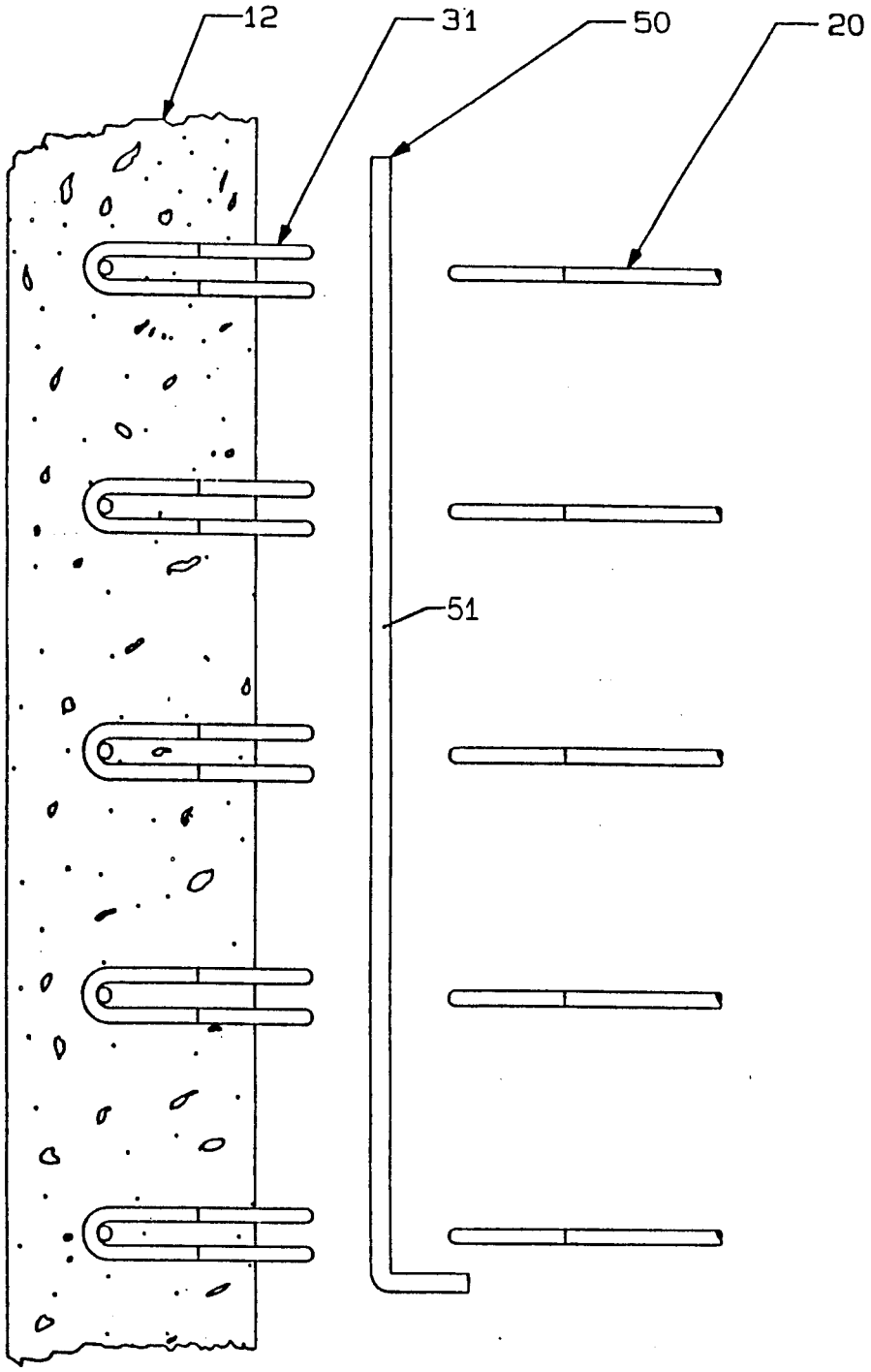
FIG. 14 is a top plan exploded view of another embodiment of the present invention.
Figure 15:
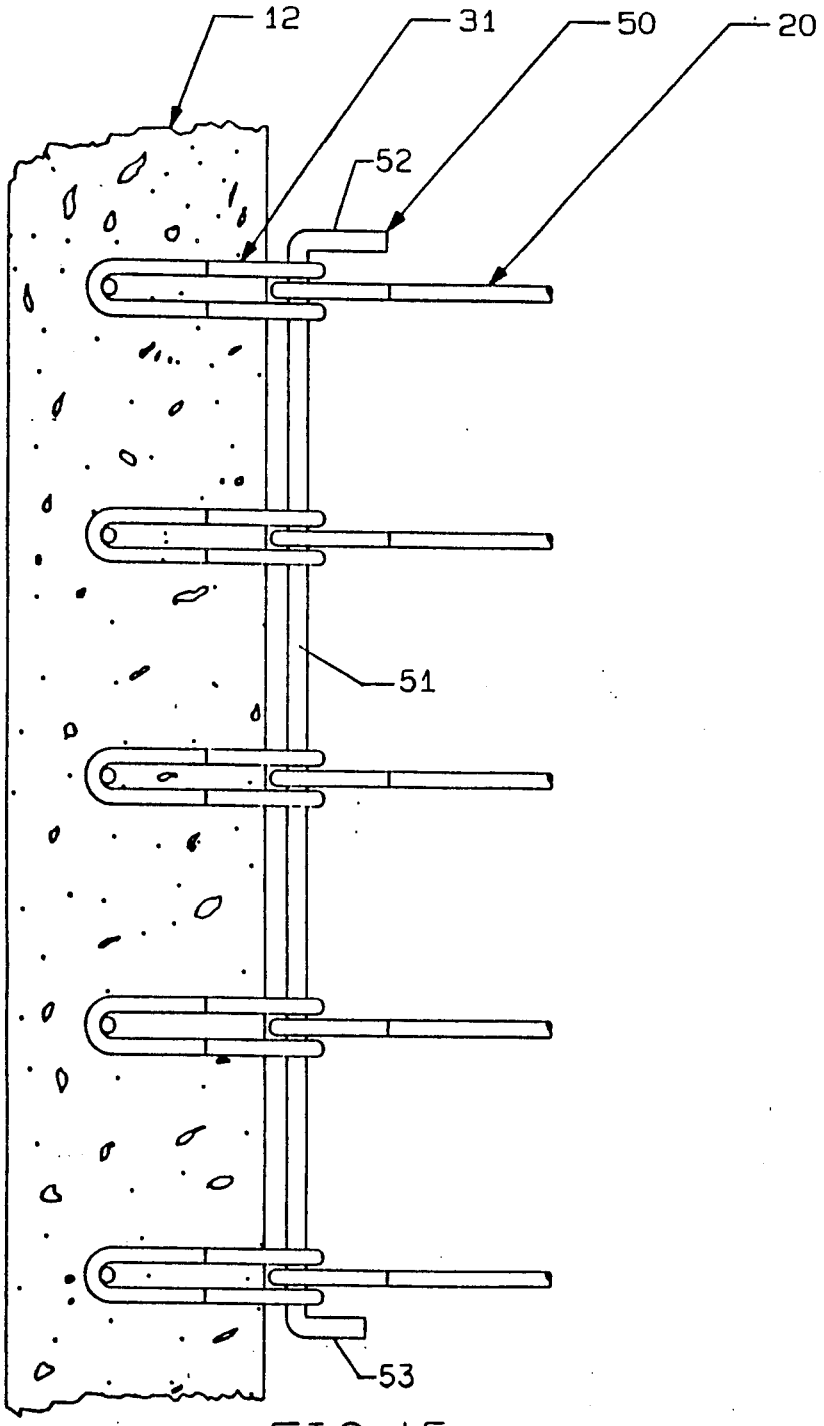
FIG. 15 is a top plan view of the assembled parts of FIG. 13.

Referring to FIGS. 14 and 15, alternatively, a single pin member 50 having a shaft 51 which is long enough to pass through all of the holes 21 and 36 in a row of clevises may be used for attaching each of the panels 16 to their respective clevises, eliminating the need for a separate nut and bolt for each clevis. The opposite ends 52, 53 of the shaft 51 are bent to prevent the wires 20 from becoming detached from the clevises 30.

Preferably, there is a two to one relationship between rows of clevis 31 and facing panels 12 so that each full facing panels has two mesh reinforcement panels atttached to its back face. However, if desired, a less or greater number of reinforcing panels may also be employed.

In the next step, soil is placed above the first tier of soil reinforcing panels to a level at which a second tier of reinforcing panels may be conveniently laid to rest in the clevises 30.

In the next step, another series of panels is interlinked with the base series of facing panels by conventional means. In the illustrated embodiment, pins are placed in holes 24 to provide additional alignment capabilities. In addition, the grooves of mating units interlink with each other. Other techniques may be employed for reinforicng the modular units as is conventional in the retaining wall and precast concrete fields. The above steps are repeated with respect to connecting soil reinforcement panel 16 in a tiered horizontally spaced series as illustrated in FIG. 2 until the desired height of the retaining wall is achieved. In the top layer half-panels are alternately positioned as illustrated in FIG. 1. The soil is conventionally compacted in horizontal layers approximately ⅔ foot in height as the wall is erected.

As set out above, a soil retaining system with the foregoing welded wire soil reinforcement mesh panels 16 resists soil stress through soil bearing on the crossbars which then transfer this stress in shear to the welded tension wires. The circular section of the wires provides the optimum end-to-surface area ratio for corrosion resistance. Overall, this is a highly effective reinforced earth retaining wall system with a particularly simplified method of attachment of the reinforcement panels to the retaining wall.

A number of modifications of the present system may be made without departing from the scope of the invention. For example, while the modular units are illustrated in a hexagonal configuration, it should be understood that other modular units may also be employed, for example, of a star-shaped or rectangular configuration, without departing from the scope of the invention. Furthermore, the number, spacing and material of the mesh reinforcement panels may be modified depending upon the characteristics desired for the overall system.

This would result in corresponding modification of the connecting units.

It is apparent from the foregoing that a unique connecting system has been provided for the interconnecting of modular soil retaining walls with wire mesh reinforcement panels which have the unique advantages of significantly reducing the labor required in the field compared to conventional techniques and which, thus, significantly reduces the costs of the system.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. The embodiment was chosen and described in order to best explain the principles of the invention and its practical application, thereby enabling others skilled in the art to understand the invention for various embodiments and with various modifications as are suited to the particular use contemplated. It is intended that the scope of the invention be defined by the claims appended hereto and their equivalents.

What is claimed is:

1. A retained earth structure comprising:

an upright retaining wall formed from a plurality of interlocked facing modules for retaining backfill material placed behind said wall;

a plurality of clevises anchored along a line in each of said modules, each of said clevises having a U-shaped portion, a pair of parallel legs which extend from said U-shaped portion a predetermined distance beyond the back surface of said module and a hole formed in the exposed end of each of said legs;

a plurality of elongated wire mesh panels which extend rearwardly from said wall into the interior of said backfill material, each of said panels having a plurality of spaced generally parallel elongated wires, a plurality of spaced generally parallel crossbars which are rigidly attached to said wires in a direction perpendicular thereto, the number of said wires in each of said panels corresponding to the number of clevises in said plurality of clevises anchored along said line in each of said modules, each of said wires having a hole formed at one end thereof, and said spacing of said wires being such that said end of each of said wires with said hole located therein fits between the legs of one of said plurality of clevises; and a coupling means which extends through the holes in the legs of each of said clevises and through the hole in the end of each of said wires fitted between said legs of each of said clevises for coupling said wire mesh panel to said module.

2. A structure according to claim 1 wherein each of said clevises including said U-shaped portion and said legs comprises reinforcing rod material having a generally circular cross-section, said hole in the free end of each of said legs is formed by bending a portion of the end of each of said legs back on itself, each of said wires in each of said wire mesh panels comprises reinforcing rod material having a generally circular cross-section and said hole in said end of each of said wires is formed by bending a portion of the end of each of said wires back on itself.

3. A structure according to claim 2 comprising an elongated member which extends from said U-shaped portion in each of said clevises in opposite directions from and in a direction generally perpendicular to the plane of said parallel legs.

4. A structure according to claim 1 wherein at least one of said holes in said legs of each of said clevises comprises a tear-shaped hole and said coupling means comprises:

a bolt and a nut, said bolt having a head on one end thereof, threads on the opposite end thereof for threadably receiving said nut, and a tear-shaped shoulder portion which extends from said head for insertion in said tear-shaped hole in said leg of said clevis for preventing rotation of said bolt when said nut is threaded thereon.

5. A clevis and wire mesh panel assembly for use in a retained earth structure which includes an upright wall, comprising:

a plurality of clevises, each of said clevises having a U-shaped portion adapted to be embedded in said wall when said wall is fabricated and a pair of relatively closely spaced legs which extend in parallel from said U-shaped portion;

an elongated generally rectangular wire mesh panel having a plurality of spaced, elongated wires and a plurality of spaced crossbars which are rigidly attached to said wires in a direction perpendicular thereto, the spacing between said legs being no larger than that which is necessary for the insertion of one of said wires therebetween; and means for coupling one end of each one of said elongated wires between said legs of a different one of said clevises.

6. An assembly according to claim 5 wherein said coupling means comprises:

a first loop formed on the ends of each leg of each one of said clevises;

a second loop formed on one end of each one of said wires in said panel;

an elongated rod-like member which fits through said first and said second loops; and means for retaining said rod-like member in said first and second loops.

7. An assembly according to claim 6 wherein said first loop comprises a tear-shaped hole and said rod-like member and said retaining means comprises:

a bolt and a nut, said bolt having a head on one end thereof, threads on the opposite end thereof for threadably receiving said nut, and a tear-shaped shoulder portion which extends from said head for insertion in said tear-shaped hole in said leg of said clevis for preventing rotation of said bolt when said nut is threaded thereon.

8. A method of making components for use in building a retained earth structure comprising the steps of:

forming a plurality of clevises from a corresponding number of sections of elongated material by bending each section so as to form a U-shaped member having a pair of parallel legs and a portion of the end of each leg back on itself so as to form a hole in the ends thereof;

casting a plurality of wall modules, each of said modules including means for assemblying said modules into an upright wall in an interlocking fashion;

anchoring a predetermined number of said plurality of clevises in a line in each of said modules during said casting of each of said modules in such a manner that a predetermined length of each of said legs of said clevises including said holes in the ends thereof extends outwardly from a rear surface of said module;

forming a plurality of elongated generally rectangular wire mesh panels by welding a plurality of spaced crossbars perpendicularly to a plurality of elongated spaced parallel wires, the number of said parallel wires in each such panel corresponding to the number of said clevises anchored in a line in each of said modules and bending a section of the end of each of said parallel wires back on itself so as to form a hole in said end, the spacing between said parallel wires being such that said hole in said ends of said wires in each panel will fit between the legs of a corresponding one of said clevises in said modules; and providing means which can be fitted through the holes in said legs and said wires for attaching each panel to corresponding clevises in said modules.

9. A method according to claim 8 wherein said sections of elongated material and said wires comprise a reinforcing bar material having a circular cross-section.

10. A method according to claim 8 wherein at least one of said holes formed in said legs of said clevises and the end of said wire to be fitted therebetween comprises a tear-shaped hole for restricting rotational movement of said attaching means when said attaching means is inserted therein.

11. A method according to claim 8 wherein said step of providing said attaching means comprises the step of providing a pin which is long enough to pass through all of the holes in the legs of said clevises and said wires and is provided at the opposite ends thereof with a means for retaining said pin in said holes.

* * * * *